US008418940B2

(12) United States Patent
Songbe et al.

(10) Patent No.: US 8,418,940 B2
(45) Date of Patent: Apr. 16, 2013

(54) SPRAY NOZZLE, DISPENSING ELEMENT COMPRISING SUCH A SPRAY NOZZLE, DISPENSER COMPRISING SUCH AN ELEMENT AND USE OF SUCH A SPRAY NOZZLE

(75) Inventors: Jean-Pierre Songbe, St Pierre en Val (FR); Bernard Clerget, Haudivillers (FR)

(73) Assignee: Rexam Dispensing Systems S.A.S. (FR)

( * ) Notice: Subject to any disclaimer, the term of this patent is extended or adjusted under 35 U.S.C. 154(b) by 1044 days.

(21) Appl. No.: 11/956,506

(22) Filed: Dec. 14, 2007

(65) Prior Publication Data

US 2008/0164346 A1 Jul. 10, 2008

(30) Foreign Application Priority Data

Dec. 15, 2006 (FR) ..... 06 10944

(51) Int. Cl.
*B05B 1/34* (2006.01)
*B05B 1/00* (2006.01)
*F02M 61/00* (2006.01)

(52) U.S. Cl.
USPC ..... 239/492; 239/468; 239/472; 239/483; 239/533.12; 239/596

(58) Field of Classification Search ..... 239/463, 239/467, 468, 472, 476, 483, 492, 533.12, 239/596
See application file for complete search history.

(56) References Cited

U.S. PATENT DOCUMENTS

| | | | | |
|---|---|---|---|---|
| 4,071,196 | A * | 1/1978 | Burke et al. | 239/492 |
| 4,358,057 | A * | 11/1982 | Burke | 239/333 |
| 5,738,282 | A * | 4/1998 | Grogan | 239/492 |
| 6,199,766 | B1 * | 3/2001 | Fox et al. | 239/3 |
| 6,371,389 | B1 * | 4/2002 | Bickart et al. | 239/491 |
| 7,198,201 | B2 * | 4/2007 | Bowman et al. | 239/1 |
| 2003/0160113 | A1 * | 8/2003 | Dobbs et al. | 239/492 |

FOREIGN PATENT DOCUMENTS

| | | | |
|---|---|---|---|
| WO | 9901227 | A1 | 1/1999 |
| WO | 03061839 | A1 | 3/2003 |

OTHER PUBLICATIONS

French Search Report, Jul. 10, 2007, 2 Pages.

* cited by examiner

*Primary Examiner* — Len Tran
*Assistant Examiner* — Justin Jonaitis
(74) *Attorney, Agent, or Firm* — St. Onge Steward Johnston & Reens LLC

(57) ABSTRACT

Spray nozzle comprising a front wall, an outlet channel delimited by a lateral surface substantially of revolution about an axis perpendicular to the front wall, an intake conduit supplying fluid product to the outlet channel, said intake conduit extending in a plane perpendicular to the axis, substantially tangentially to the lateral surface of the outlet channel, between an upstream and a downstream end opening out into the lateral surface of the outlet channel, the lateral surface of the outlet channel comprising a relief arranged radially relative to the axis and suitable for forming a static surface layer of fluid product.

9 Claims, 3 Drawing Sheets

SPRAY NOZZLE, DISPENSING ELEMENT COMPRISING SUCH A SPRAY NOZZLE, DISPENSER COMPRISING SUCH AN ELEMENT AND USE OF SUCH A SPRAY NOZZLE

CROSS-REFERENCE TO RELATED APPLICATIONS

The present application claims priority of French patent application No. 06 10944 filed on Dec. 15, 2006, the content of which is incorporated herein by reference.

FIELD OF THE INVENTION

The invention relates to a spray nozzle, a dispensing element comprising a spray nozzle of this type, a dispenser comprising such an element as well as a use for a spray nozzle of this type.

BACKGROUND OF THE INVENTION

In particular, the invention relates to a spray nozzle for a fluid product comprising:

a front wall, an outlet channel extending through said front wall, said outlet channel being delimited by a lateral surface substantially of revolution about an axis perpendicular to the front wall, the lateral surface of the outlet channel comprising at least one relief arranged radially in relation to the axis, an intake conduit suitable for feeding the fluid product into the outlet channel, the intake conduit and the outlet channel being suitable for entraining the fluid product in a rotation movement about the axis in a direction of rotation, said intake conduit extending in a plane perpendicular to the axis, substantially tangentially in relation to the lateral surface of the outlet channel, between an upstream end suitable for being fed with the fluid product and a downstream end opening into the lateral surface of the outlet channel.

Such a spray nozzle is used to obtain, at the exit from the outlet channel, a dispensing to the outside of the fluid product under pressure in the form of an aerosol composed of individual droplets, and having a conical shape with a determined spraying angle.

Such a spray nozzle is known in particular from document EP-0 796 661 which provides for projections formed on the lateral surface of a swirl chamber.

However, the known spray nozzle poses problems for spraying a viscous fluid product, i.e. a fluid product having a viscosity greater than 0.001 Pa·s at 20° C.

Actually, the lateral surface of the outlet channel causes an uncontrolled disturbance of the circulation of the fluid product in the outlet channel. The result is a global loss of head for the fluid product, and a reduction in the pressure at which the fluid product is entrained.

The fluid product leaves the spray nozzle in the form of an aerosol comprising droplets of various dimensions, possibly substantial, and the spraying angle of which is reduced, for example to 10°, namely in the form of a jet.

SUMMARY OF THE INVENTION

The invention aims to solve the problems mentioned above.

To this end, the invention proposes a spray nozzle of the type mentioned above, in which the relief comprises at least one recess arranged on the lateral surface of the outlet channel and suitable for forming a static surface layer of fluid product.

Thus, the recess makes it possible to line the lateral surface of the outlet channel with a layer of immobilized fluid product, over which the remainder of the fluid product can slide without friction.

By inserting a static surface layer of fluid product between the lateral surface of the outlet channel and the circulating fluid product, the global loss of head of the fluid product is limited and the pressure with which the fluid product is entrained is maintained. At the outlet of the spray nozzle, the fluid product can break up into fine droplets and form an aerosol having the desired spraying angle.

In particular embodiments, the spray nozzle can have, optionally in addition, one or more of the following arrangements:

the outlet channel comprises an upstream section forming a swirl chamber and having a first cross section, and a downstream section forming an outlet orifice and having a second cross section of smaller dimensions than those of the first cross section, the downstream end of the intake conduit opening into the lateral surface of the swirl chamber, the relief being worked on the lateral surface of the swirl chamber;

the outlet channel comprises a section forming an outlet orifice which extends between an upstream end and a downstream end, the downstream end of the intake conduit opening into the lateral surface of the outlet orifice in the vicinity of the upstream end of said outlet orifice, the relief being arranged on the lateral surface of the outlet orifice: the losses of head are further limited by the fact that the intake conduit opens directly into the outlet orifice;

the recess forms a slope departing from the axis is the direction of rotation of the fluid product in the outlet channel;

the relief comprises a plurality of asperities forming a roughness of the lateral surface of the outlet channel;

the spray nozzle comprises several intake conduits.

Another subject of the invention is a dispensing element comprising a generally cylindrical body and a spray nozzle as defined above, the body comprising a housing having a abutment surface, and a supply channel suitable for feeding the housing with fluid product, the spray nozzle being arranged in the housing, the front wall delimiting the housing outwards and coming into contact with the abutment surface, the upstream end of the intake conduit communicating with the supply channel.

Moreover, the invention proposes a dispenser comprising:

a reservoir having an opening and suitable for containing a fluid product, a dispensing device mounted in the opening and comprising a stem that can be moved in translation, communicating with the reservoir and suitable for delivering the fluid product under pressure, a dispensing element as defined above, mounted on the stem in order to move said stem, the supply channel being in communication with the stem.

The reservoir can contain a fluid product having a viscosity less than or equal to 10 Pa·s at 20° C.

A further subject of the invention is a use of a spray nozzle as defined above to spray a fluid product which has a viscosity less than or equal to 10 Pa·s at 20° C.

BRIEF DESCRIPTION OF THE DRAWINGS

Other subjects and advantages of the invention will become apparent on reading the following description, made with reference to the attached drawings, in which.

DETAILED DESCRIPTION OF THE INVENTION

In the figures, the same references designate identical or similar elements.

Figure 1:
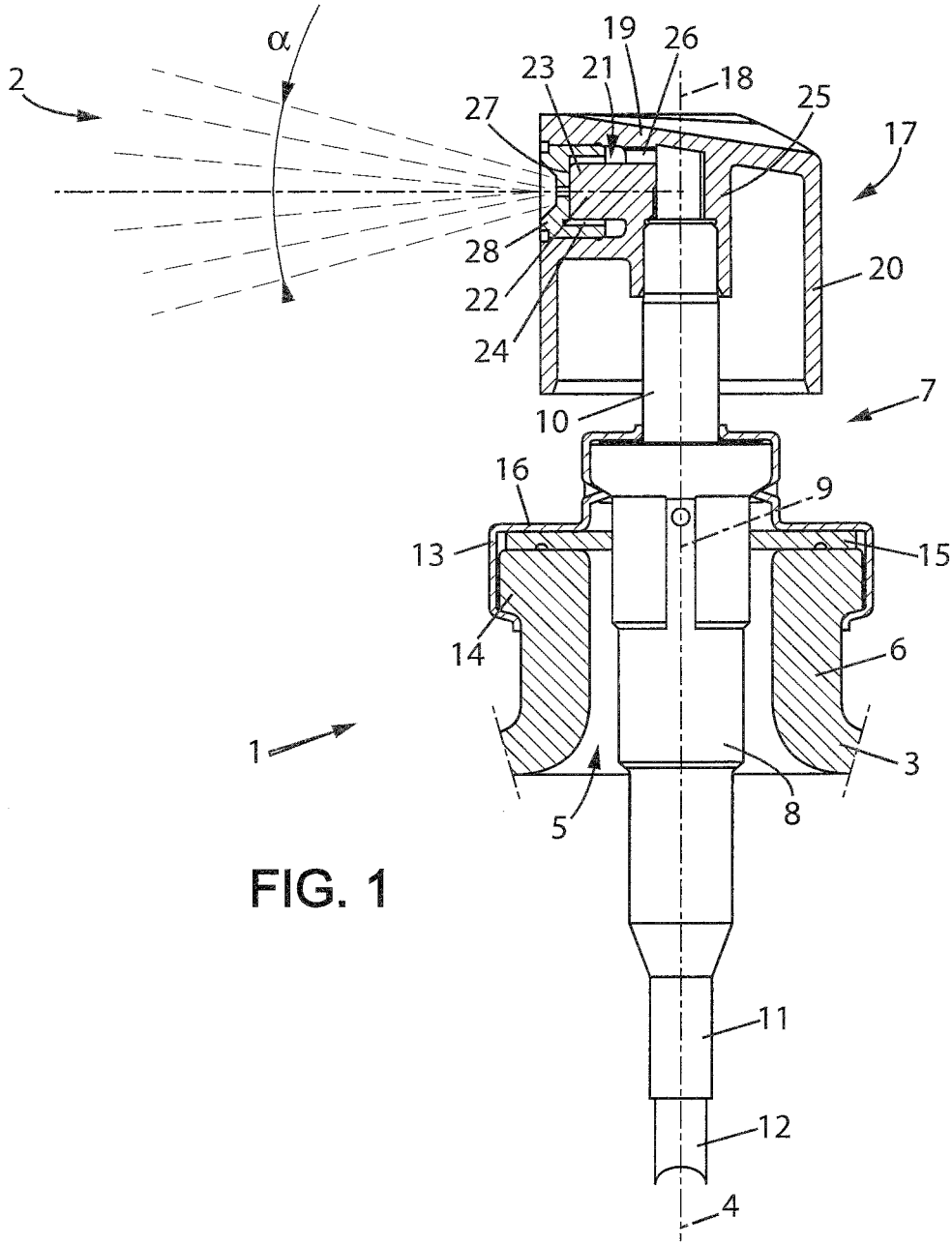
FIG. 1 is a partial view in longitudinal section of a fluid product dispenser comprising a spray nozzle.

FIG. 1 shows a dispenser 1 allowing a fluid product to be sprayed, i.e. the dispensing of the fluid product in the form of an aerosol 2 composed of individual droplets and having a generally conical shape with a determined spraying angle $\alpha$.

The dispenser 1 comprises a reservoir 3 containing the fluid product. The reservoir 3 can comprise a bottom and a generally cylindrical wall which extends about an axis 4 perpendicular to the base. The reservoir 3 has an opening 5 provided opposite the bottom and delimited, for example, by a tubular neck 6 which extends approximately coaxially to the axis 4 of the reservoir 3.

A dispensing device 7 mounted in the opening 5 of the reservoir 3 is suitable for taking the fluid product inside the reservoir 3 and delivering it to the outside under pressure.

In the remainder of the description the terms "bottom" or "lower" and "top" or "upper" are understood in relation to the orientation of the reservoir 3 resting on its base. The terms "upstream" and "downstream" will be understood in relation to the direction of circulation of the fluid product from the reservoir to the outside.

The dispensing device 7 can comprise a tubular body 8 which extends along an axis 9 and a hollow stem 10 mounted in the open upper end of the body 8. The stem 10 is partially movable in translation inside the body 8 along the axis 9. The lower end of the body 8 also open is in communication with the reservoir 3, for example by means of a tubular fixing wall 11 receiving a slip-fitted plunger tube 12.

In particular examples, the dispensing device 7 can be manually operated. The dispensing device 7 can be a valve mounted on the reservoir 3, which is then pressurized, and in which the stem 10 comprises at least a closable orifice which can be put in communication with the inside of the body 8. By way of a variant, the dispensing device 7 can be a pump comprising a compression chamber delimited by an inlet valve close to the lower end of the body 8, an outlet valve and a piston integral with the base of the stem 10 and movable in a tight manner inside the body 8.

The dispensing device 7 is fixed coaxially on the neck 6 of the reservoir 3. As the free lower end of the plunger tube 12 rests close to the bottom of the reservoir 3 so as to put the stem 10, the upper end of which projects relative to the opening 5 of the reservoir 3, in communication with the reservoir 3. The stem 10 can thus deliver the fluid product under a pressure, for example greater than 2 bars.

In other embodiments which are not shown, it could be provided that the reservoir 3 has a lower opening 5 and that the dispensing device 7 operates in reverse, i.e. with the stem 10 extending downwards. In this case, the plunger tube 12 is replaced by a suitable pick-up device.

In the embodiment shown, a fixing element fixes the dispensing device 7 to the reservoir 3. For example, in FIG. 1, the fixing element is a metal ring 13 which is crimped on one side, onto a flange integral with the body 8 of the dispensing device and on the other, onto a shoulder 14 of the neck 6. It can be provided to place a seal 15 between the upper surface of the neck 6 and a radial surface 16 of the ring 13. However, the fixing of the dispensing device 7 to the reservoir is not limited to this embodiment.

In order to actuate the dispensing device 7 by moving the stem 10 inside the body 8, a dispensing element, for example in the form of a push button 17, can be mounted on the upper end of the stem 10.

The push button 17 comprises a generally cylindrical body which extends along an axis 18. The body presents an upper actuation wall 19 which extends substantially radially relative to the axis 18 of the push button 17 and from the edge of which a lateral skirt 20 extends along the axis 18 of the push button 17.

In the vicinity of the actuation wall 19, the body of the push button 17 can comprise a cylindrical housing 21 along an axis 22 generally perpendicular to the axis 18 of the push button 17, arranged in the lateral skirt 20 and having a abutment surface. In particular, inside the housing 21, a cylindrical block 23 can extend coaxially to the axis 22 of the housing 21 so as to form a substantially annular space 24 inside the cylindrical housing 21. The block 23 has a downstream end surface 27 forming the abutment surface which extends generally perpendicularly to the axis 22 of the housing 21.

The push button 17 also comprises a supply channel in communication with the stem 10. The supply channel can comprise, for example, an axial sleeve 25 which extends from the actuation wall 19 inside the skirt 20 along the axis 18 of the body, and a radial passage 26 generally perpendicular to the axis 18 of the body and of which the upstream and downstream ends open respectively into the axial sleeve 25 and into the annular space 24 of the housing 21. The lower end of the axial sleeve 25 can be fixed in a tight manner, for example by slip fit and/or spring clip, on the upper end of the stem 10.

The supply channel allows the housing 21 to be fed with fluid product under pressure delivered by the stem 10.

In other embodiments, it is possible however, to arrange for the axis 22 of the housing 21 and the supply channel to be parallel, merged or not, to the axis 18 of the dispensing element in order to allow an axial dispensing of the fluid product. Moreover, the dispensing element can form a fitting mounted on a dispensing device 7 or directly on the reservoir 3.

In order to allow the fluid product to leave under pressure in the form of an aerosol 2 composed of fine individual droplets, a spray nozzle 28 is arranged in the housing 21.

In particular, the spray nozzle 28 comprises a front wall 29 which has an upstream face 33 and a downstream face 34 and which delimits the housing 21 to the outside.

The spray nozzle 28 also comprises an outlet channel which extends through the front wall 28.

Figure 2:
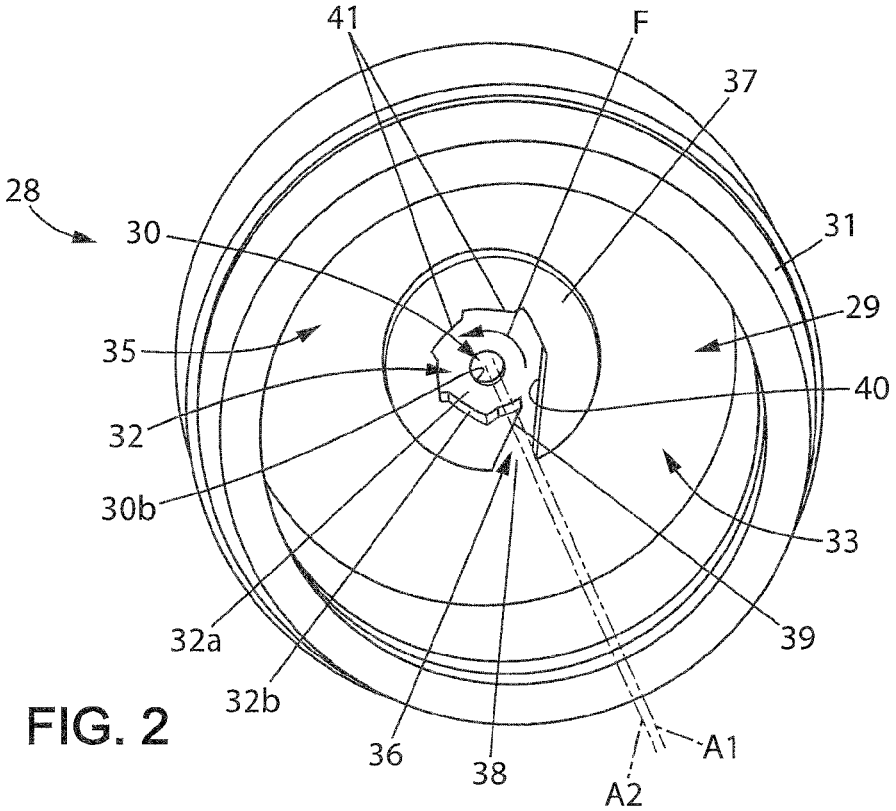
FIG. 2 is an enlarged perspective view of the spray nozzle of the dispenser of FIG. 1 according to an embodiment.
Figure 3:
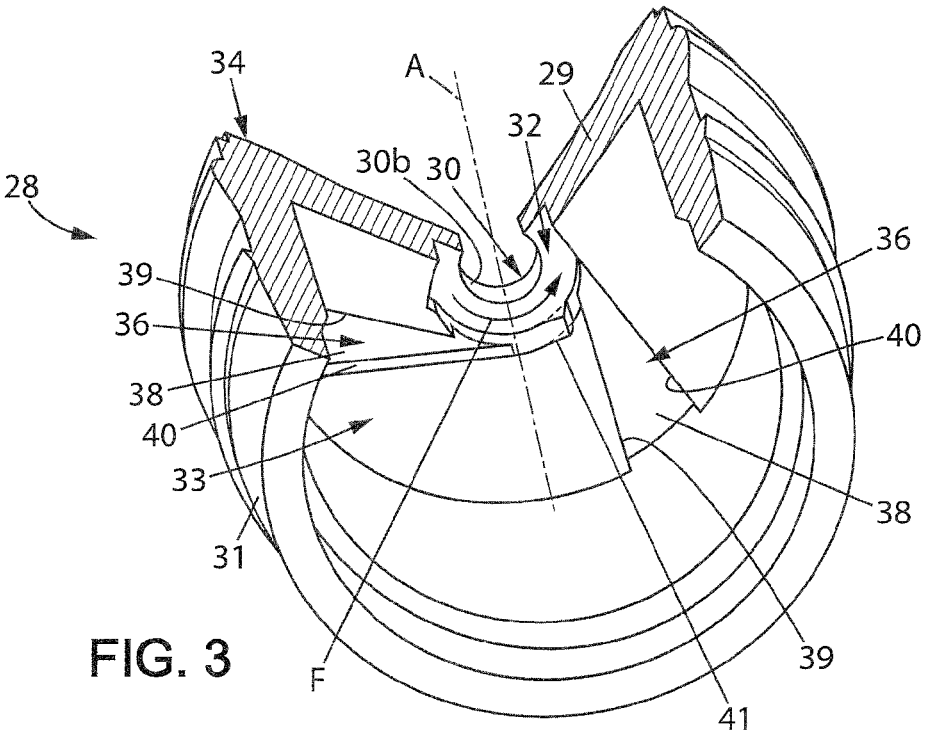
FIG. 3 is a truncated enlarged perspective view of the spray nozzle of the dispenser of FIG. 1 according to a variant.
Figure 4:
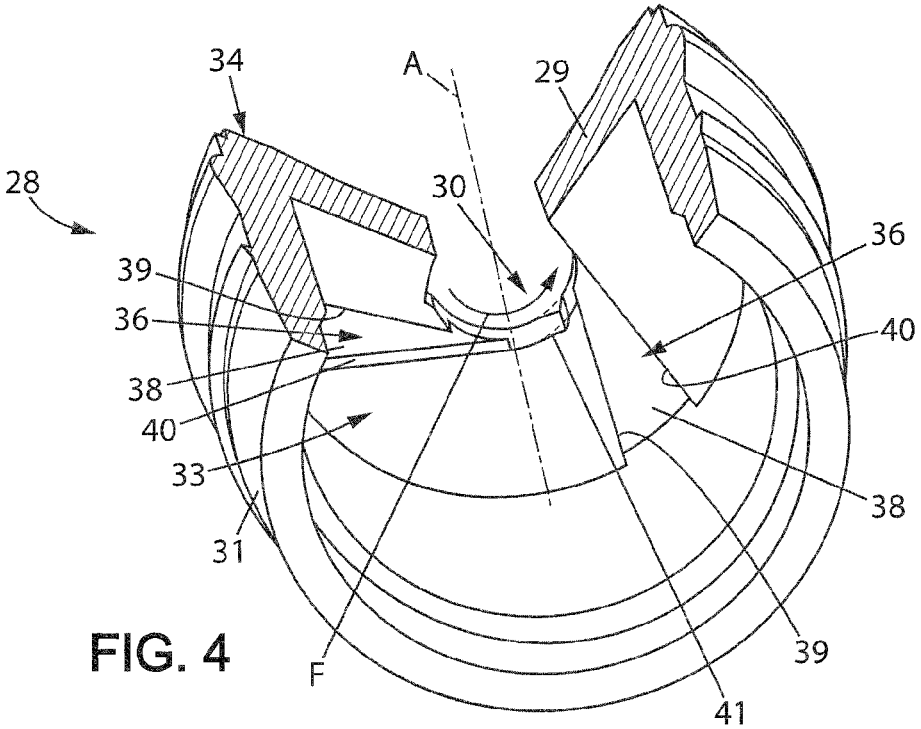
FIG. 4 is a truncated enlarged perspective view of the spray nozzle of the dispenser of FIG. 1 according to a variant.
Figure 5:
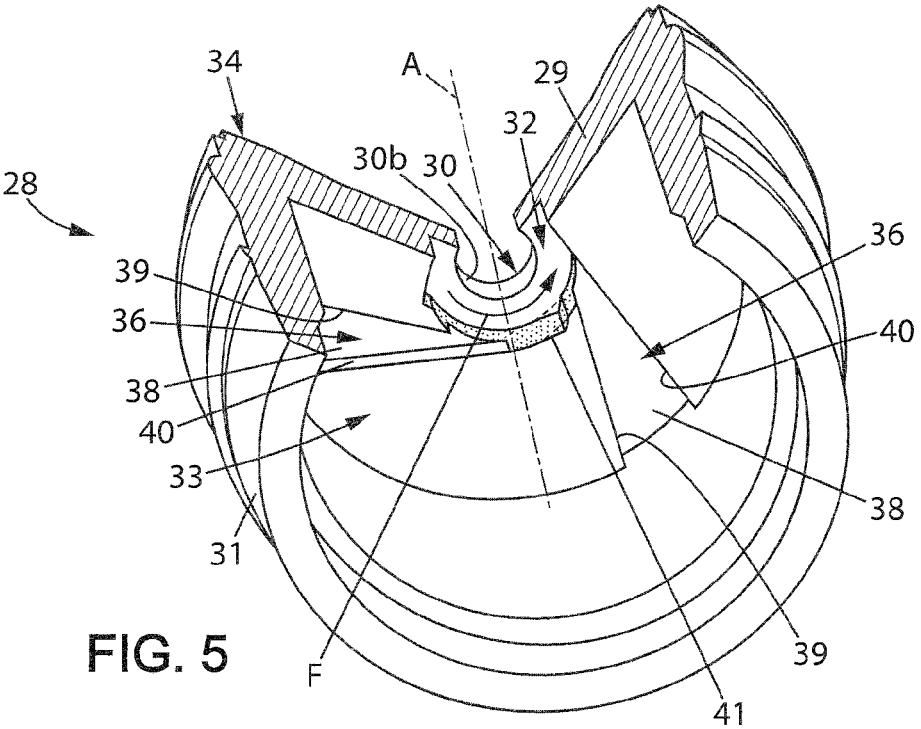
FIG. 5 is a truncated enlarged perspective view of the spray nozzle of the dispenser of FIG. 1 according to a variant.

In FIGS. 2 and 3, the outlet channel comprises an upstream section forming a swirl chamber 32 and a downstream section forming an outlet orifice 30.

The swirl chamber 32 is delimited by a front surface **32*a* formed on the upstream face 33 of the front wall 29 and a lateral surface 32*b* substantially of revolution about an axis A1 perpendicular to the front wall 29. For example, the lateral surface 32*b* of the swirl chamber 32** can be substantially cylindrical and have a first cross section.

The outlet orifice 30 extends between an upstream end worked on the front surface **32*a* of the swirl chamber 32 and a downstream end arranged on the downstream face 34 of the front wall 29 to open to the outside. The outlet orifice 30 is delimited by a lateral surface 30*b* substantially of revolution about an axis A2 perpendicular to the front wall 29. For example, the lateral surface 30***b* of the outlet orifice 30 can be approximately cylindrical and have a second cross section of smaller dimensions than those of the first cross section.

By lateral surface substantially of revolution, is meant a surface generated by the movement of a rectilinear generatrix, in the case of a cylindrical or frustoconical surface or curve, parallel to the corresponding axis, along a closed directrix curve, in particular a circle or an ellipse. A lateral surface approximately of revolution also designates such a surface having local singularities, as described below.

Thus, it can be provided that the section of the outlet orifice 30 is circular or elliptical. The lateral surface 30*b* of the outlet orifice 30 can also be frustoconical with a convergence or a divergence between its upstream end and its downstream end.

Moreover, the axis A2 of the outlet orifice 30 can be offset relative to the axis A1 of the swirl chamber 32, as shown in FIG. 2, or merged with the axis A1 of the swirl chamber 32 to form a common axis A of the lateral surface of the outlet channel, which lateral surface is formed jointly by the lateral surfaces 30*b*, 32*b* of the outlet orifice 30 and the swirl chamber 32.

To bring the fluid product under pressure into the swirl chamber 32 of the outlet channel, the spray nozzle 28 comprises at least one intake conduit 36. The intake conduit 36 and the swirl chamber 32 are suitable for entraining the fluid product in a rotation movement about the axis A1 of the swirl chamber 32 in a direction of rotation shown in FIGS. 2 and 3 by an arrow F.

Each intake conduit 36 extends in a plane perpendicular to the axis A1 of the swirl chamber 32 between an upstream end and a downstream end. Each intake conduit 36 extends tangentially relative to the lateral surface 32*b* of the swirl chamber 32 and the downstream end of each intake conduit 36 opens into the lateral surface 32*b* of the swirl chamber 32.

Each intake conduit 36 can be delimited by a bottom surface 38 and internal lateral edges 39 and external edges 40 substantially perpendicular to the bottom surface 38. It can be provided that the lateral edges 39, 40 converge towards each other from the upstream end towards the downstream end of the intake 36.

In particular, the external lateral edge 40 can be approximately rectilinear and connect tangentially to the lateral surface 32*b* of the swirl chamber 32. And the internal lateral edge 39, also approximately rectilinear, can connect to the lateral surface 32*b* of the swirl chamber 32 while being inclined relative to a direction parallel to the external lateral edge 40.

In the embodiment represented in FIG. 2, the front wall 29 can have, on its upstream face 33, a generally flat front surface and an annular boss 37, for example consisting of a single piece with the front wall 29, projecting from the front surface of the front wall 29. The annular boss 37 delimits the swirl chamber 32 internally. The annular boss 37 also delimits a peripheral chamber 35 externally.

The boss 37 can comprise a single groove formed by a break in the boss 37 and delimiting the single intake conduit 36. The bottom surface 38 of the intake 36 can be approximately coplanar with the front surfaces of the swirl chamber 32 and of the front wall 29. The downstream end of the intake conduit 36 then opens out into the lateral surface 32*b* of the swirl chamber 32 and the upstream end of the intake conduit 36 opens out into the peripheral chamber 35.

It can nevertheless be provided that the boss 37 comprises several grooves, each delimiting an intake conduit 36.

By way of a variant shown in FIG. 3, the swirl chamber 32 is recessed in the front wall 29 such that the front surfaces of the swirl chamber 32 and of the front wall 29 are axially offset relative to each other.

In this variant, the spray nozzle 28 can comprise one or several intake conduits 36, for example three evenly distributed sections, of which the downstream ends open out into the lateral surface 32*b* of the swirl chamber 32.

In particular, the intake conduits 36 can be formed by grooves arranged in hollows in the front wall 29. The bottom surface 38 of each intake 36 can for example be arranged between the front surface of the front wall 29 and the front surface 32*a* of the swirl chamber 32.

In order to improve the global circulation of the fluid product inside the outlet channel, in particular in the swirl chamber 32 according to the embodiment shown, it is provided that the lateral surface 32*b* of the swirl chamber 32 comprises a relief arranged radially relative to the axis A1 and adapted to form a static surface layer of fluid product.

The relief then forms, on the lateral surface 32*b* of the swirl chamber 32, a singularity which immobilizes a stable surface layer of fluid product. The circulation of the fluid product on the lateral surface 32*b* forms a limiting layer on the lateral surface 32*b* which is immobilised by the relief in order to line the lateral surface 32*b* with a coating layer of a determined thickness on which the remainder of the fluid product can slide without friction.

In FIGS. 2 and 3, the relief comprises a plurality of evenly distributed recesses 41 arranged on the lateral surface 32*b* of the swirl chamber 32. In particular, each recess 41 can form a slope departing from the axis A1 relative to the direction of rotation F of the fluid product in the swirl chamber 32. It can however be provided for the relief to comprise only a single recess.

Moreover, the relief can comprise one or more serrations parallel to the axis A2. It can also be provided for the relief to comprise a plurality of asperities forming a roughness of the lateral surface of the outlet channel, wherein the roughness can be local, distributed, continuous or discontinuous.

In another embodiment, not shown, the outlet channel can comprise a single section only, forming the outlet orifice 30 which extends between an upstream end and a downstream end opening respectively out into the upstream face and the downstream face of the front wall 29. Each intake conduit 36 then extends tangentially to the lateral surface 30*b* of the outlet orifice 30 on which the relief is provided. The downstream end of each intake conduit 36 opens out into the outlet orifice 30 in the vicinity of the upstream end of said outlet orifice 30.

The spray nozzle 28 can constitute an attached element which is slip-fitted in the housing 21 of the push button 17. The spray nozzle 28 can then comprise, on the side of the upstream face 33 of the front wall 29, a connecting wall 31 which extends in the vicinity of the periphery of the front wall 29 approximately perpendicular to the front wall 29.

The connecting wall 31 of the spray nozzle 28, optionally provided with seals, is slip-fitted inside the housing 21 parallel to the axis 22 of the housing 21, until the front wall 29 comes into contact with the abutment surface 27 of the block 23. In the embodiment of FIG. 2, the boss 37 comes into contact with the abutment surface 27 and, in the variant of FIG. 3, the front surface of the front wall 29 comes into contact with the abutment surface 27.

It can however be provided, in a other embodiment, for the spray nozzle 28 to be formed in a single piece with the body of the dispensing element 17, the abutment surface 27 being attached, for example by the insertion of a block fixed in the housing 21. In this way the risks of expulsion of the spray nozzle 28 during atomization of the fluid product are avoided.

The swirl chamber 32 then constituted at the interface between the front wall 29 and the abutment surface 27 is delimited by the front surface 32*a*, the abutment surface 27 and the lateral surface 32*b* extending between the front surface 32*a* and the abutment surface 27. The intake conduit 36 is for its part delimited by the bottom surface 38, the abutment surface 27 and the lateral edges 39, 40 which extend between the bottom surface 38 and the abutment surface 27.

Moreover, the upstream end of each intake conduit 36 is placed in communication, either via the peripheral chamber 35 in the embodiment of FIG. 2 or directly in the variant of FIG. 3, with the annular space 24 and the radial passage 26 of the supply channel.

When a user presses on the upper actuation wall 19 of the push button 17, the stem 10, moved downwards, delivers the fluid product under pressure to the axial sleeve 25 and the radial passage 26 of the supply channel as far as the annular space 24 of the housing 21.

The upstream end of the intake conduit 36 is fed with fluid product under pressure, which fluid product is then entrained tangentially into the swirl chamber 32, or directly into the outlet orifice 30, by said intake conduit 36. The fluid product can be given a rotation movement in the outlet orifice 30 and leave the dispenser 1 in the form of the aerosol 2 composed of fine individual droplets and in a generally conical shape with the desired spraying angle, for example less than or equal to 80°.

The use of the spray nozzle 28 according to the embodiments described above allows the desired aerosol 2 to be obtained from the start to the end of the actuation of the dispenser and throughout the period of use of the dispenser 1.

The spray nozzle 28 as described above can be used for spraying any type of fluid product, for example a viscous fluid product, having a viscosity greater than 0.001 Pa·s at 20° C. It is also provided that the spray nozzle 28 can be used to spray a fluid product which has a viscosity less than or equal to 10 Pa·s at 20° C.

The fluid product placed inside the reservoir 3 can therefore have a viscosity in the range provided for above.

What is claimed is:

1. A spray nozzle for a fluid product comprising:

a front wall, an outlet channel extending through said front wall, said outlet channel being delimited by a lateral surface substantially of revolution about an axis perpendicular to the front wall, the lateral surface of the outlet channel comprising at least one relief arranged radially in relation to the axis, an intake conduit suitable for feeding the fluid product into the outlet channel, the intake conduit and the outlet channel being suitable for entraining the fluid product in a rotation movement about the axis in a direction of rotation, said intake conduit extending in a plane perpendicular to the axis, substantially tangentially to the lateral surface of the outlet channel, the intake conduit extending between an upstream end suitable for being fed with fluid product and a downstream end opening into the lateral surface of the outlet channel, wherein the relief comprises at least one recess arranged on the lateral surface of the outlet channel, said lateral surface consisting of a surface that is generated by the movement of a rectilinear or curved generatrix, parallel to the axis, along a closed circular or elliptic directrix, and that presents locally a slope departing from the axis in the direction of rotation of the fluid product in the outlet channel and forming the recess, said recess being suitable for forming a static surface layer of fluid product.

2. The spray nozzle according to claim 1, in which the outlet channel comprises an upstream section forming a swirl chamber and having a first cross section, and a downstream section forming an outlet orifice and having a second cross section of smaller dimensions than those of the first cross section, the downstream end of the intake conduit opening into the lateral surface of the swirl chamber, the relief being arranged on the lateral surface of the swirl chamber.

3. The spray nozzle according to claim 1, in which the outlet channel comprises a section forming an outlet orifice which extends between an upstream end and a downstream end, the downstream end of the intake conduit opening into the lateral surface of the outlet orifice in the vicinity of the upstream end of said outlet orifice, the relief being arranged on the lateral surface of the outlet orifice.

4. The spray nozzle according to claim 1, in which the relief comprises a plurality of asperities forming a roughness of the lateral surface of the outlet channel.

5. The spray nozzle according to claim 1, comprising several intake conduits.

6. A dispensing element comprising a generally cylindrical body and a spray nozzle according to claim 1, the body comprising a housing having an abutment surface, and a supply channel suitable for feeding the housing with fluid product, the spray nozzle being arranged in the housing, the front wall delimiting the housing outwards and coming into contact with the abutment surface, the upstream end of the intake conduit being in communication with the supply channel.

7. A dispenser comprising:

a reservoir having a opening and suitable for containing a fluid product, a dispensing device mounted in the opening and comprising a stem that can be moved in translation, communicating with the reservoir and suitable for delivering the fluid product under pressure, a dispensing element according to claim 6, mounted on the stem for moving said stem, the supply channel being in communication with the stem.

8. The dispenser according to claim 7, in which the reservoir contains a fluid product having a viscosity less than or equal to 10 Pa·s at 20° C.

9. Use of a spray nozzle according to claim 1 to spray a fluid product which has a viscosity less than or equal to 10 Pa·s at 20° C.

* * * * *